United States Patent [19]

Jacrot

[11] Patent Number: 4,686,410

[45] Date of Patent: Aug. 11, 1987

[54] INCANDESCENT LAMP HAVING A REFLECTING SCREEN AND TONGUE

[75] Inventor: Michel Jacrot, Barjouville Chartres, France

[73] Assignee: U.S. Philips Corporation, New York, N.Y.

[21] Appl. No.: 757,964

[22] Filed: Jul. 23, 1985

[30] Foreign Application Priority Data

Aug. 3, 1984 [FR] France ..... 84 12310

[51] Int. Cl.[4] ..... H01K 1/26

[52] U.S. Cl. ..... 313/113; 313/580

[58] Field of Search ..... 313/113, 114, 115, 578–580

[56] References Cited

U.S. PATENT DOCUMENTS 3,646,385 2/1972 Wichert ..... 313/115

4,361,780 11/1982 Brons ..... 313/579 X

*Primary Examiner*—Palmer C. DeMeo

*Assistant Examiner*—Sandra L. O'Shea

*Attorney, Agent, or Firm*—David R. Treacy

[57] ABSTRACT

According to the invention, an electric incandescent lamp provided with a longitudinally arranged filament (6) and an elongate concave screen (11) cooperating with the filament has in this screen (11) a reflecting tongue (16), which gradually moves away from a flat base portion (13) of this screen (11) and faces the filament (6) throughout its length and extends towards the end (7) of the filament (6) remote from the seal (2) of the lamp vessel (1). The lamp, when used in a headlight having a flattened paraboloidal reflector, produces a dipped beam of higher luminous intensity.

8 Claims, 4 Drawing Figures

INCANDESCENT LAMP HAVING A REFLECTING SCREEN AND TONGUE

BACKGROUND OF THE INVENTION

The invention relates to an electric incandescent lamp provided with a tubular glass lamp vessel which is sealed in a gas-tight manner and has a seal at a first end;

current supply conductors entering the lamp vessel through said seal;

a helically wound filament which is longitudinally arranged in the lamp vessel and has at each of its ends a limb which is connected to a respective current supply conductor;

an elongated concave reflecting screen in the lamp vessel, which extends along the filament whilst facing said filament with its concave side, this screen being curved substantially spherically at its end facing the said seal, has a vane at its other end extending longitudinally in the lamp vessel and has a flat base portion.

Such a lamp is known inter alia from European Patent Application No. 0098905 (Cibie Projecteurs 25 01 84). The lamp can be used as a headlight in vehicles, the filament then producing a dipped beam. If a second filament not cooperating with the concave screen is arranged in the lamp vessel, a main beam can be obtained thereby. Such a lamp having two longitudinal filaments and a halogen-containing gas filling is designated as an H4 lamp.

Many vehicles have headlights which are provided with a flattened paraboloidal reflector. With the use of an incandescent lamp of the kind described in the opening paragraph in a flattened reflector, the reflecting screen reflects a considerable quantity of light onto a flat portion of the reflector. This light provides a very small contribution to the dipped beam emitted by the headlight.

According to the invention described in the Application No. 0098905, a reflecting screen is used which is curved spherically at its end remote from the seal. As a result, a larger quantity of the light generated by the filament is contained in the beam emitted by the headlight. However, a disadvantage of this screen is that it does not exhibit a longitudinal vane. A further disadvantage is that a differently shaped screen has to be used.

SUMMARY OF THE INVENTION

The invention has for its object to provide a lamp of the kind described in the opening paragraph, by means of which, whilst using a conventional screen, a dipped beam is obtained from a flattened paraboloidal reflector which has a higher luminous intensity than the beam obtained by the lamp described in the opening paragraph.

In a lamp of the kind described in the opening paragraph, this is achieved according to the invention in that a reflecting tongue is present in the screen, which faces the filament throughout its length and gradually moves away from the flat base portion of the screen and extends towards the end of the filament remote from the seal of the lamp vessel.

The tongue may be a separate part of the screen and may be secured to its base portion by means of, for example, one or more welds, or it may be an integral part of the screen and may be stamped out of the body of the screen and bent inwardly towards the filament.

Since in the latter case the tongue is located closer to the filament than the opening in the screen out of which the tongue is bent, the tongue can readily screen this opening from light emitted from the filament. Due to its position, the tongue reflects at least part of the light that would leave the lamp vessel substantially radially in the absence of the tongue rather in a longitudinal direction towards the seal of the lamp vessel. As a result, with the use of a flattened paraboloidal reflector, this light inpinges for a considerable part on the curved surface of the reflector and it provides a contribution to the beam formed by this surface.

The shape of the tongue may be chosen from a variety of shapes. A shape concave towards the filament, for example a cylindrically bent tongue, in which the cylindrical axis is arranged at right angles to the tubular lamp vessel, has proved favourable. Another example of a concave tongue is a spherically curved tongue, whose concave side faces the filament.

The object of the invention is achieved whilst maintaining the vane at the end of the screen remote from the seal of the lamp vessel and maintaining substantially the contours of a conventional screen. The vane at the screen may therefore be utilized, if desired, to secure thereto one of the limbs of the filament. Consequently, the filament occupies a position accurately fixed with respect to the screen. If the screen is supported by a current supply conductor, which is generally the case, this limb is thus connected to this current supply conductor. The vane at the screen may also be used, if desired, to support the interior of the lamp on the wall of the lamp vessel. For this purpose, in many cases the vane has a lateral projection which engages the wall of the lamp vessel. Especially if the current supply conductors in the seal of the lamp vessel have a foil-shaped part, the vane at the screen engaging the wall of the lamp vessel prevents the inner parts of the lamp from occupying an oblique position when this seal is established.

BRIEF DESCRIPTION OF THE DRAWING

Embodiments of the lamp of the invention are shown in the drawing, in which.

Figure 1:
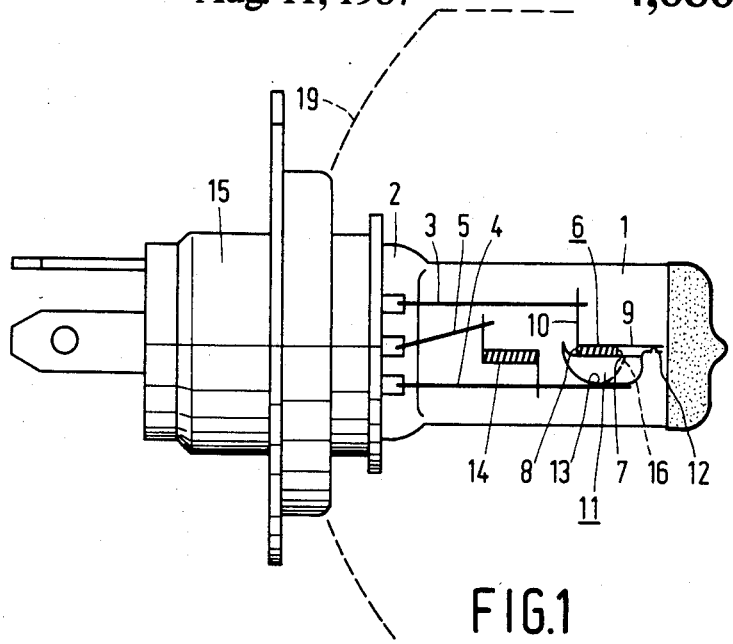
FIG. 1 is a side elevation of a lamp with the screen in side elevation.

The drawing is schematic only and not to scale.

DESCRIPTION OF THE PREFERRED EMBODIMENTS

The lamp shown in FIG. 1 has a tubular lamp vessel 1 of glass, for example, quartz glass, which is sealed in a gas-tight manner and has a seal 2 at a first end. Current supply conductors 3, 4 and 5 enter through this seal of the lamp vessel 1. A helically wound filament 6 is longitudinally arranged in the lamp vessel 1 and is provided at each of its end 7, 8 with a limbs 9, 10, respectively, which are connected to current supply conductors 4 and 3, respectively. The end 7 is remote from the seal 2 of the lamp vessel 1. An elongate concave reflecting screen 11 extends in the lamp vessel 1 along the filament 6 with its concave side facing this filament. The screen 11 is curved substantially spherically at its one end facing the seal 2 and has a vane 12 longitudinally extending in the lamp vessel at its other end. The screen 11 also has a flat base portion 13. The screen 11 is supported by the current supply conductor 4. The limb 9 is secured to the vane 12, as a result of which this limb 9 is electrically connected to the current supply conductor 4. The lamp is arranged in a headlight(not shown) having a parabolically flattened reflector 19 (indicated diagrammatically by dashed lines) and a lens (not shown). During operation of the lamp, the screen 11, the paraboloidal flattened reflector 19, and the lens combine to produce a dipped beam from the filament 6.

The lamp has a second longitudinally arranged filament 14 connected to the current supply conductors 4, 5. During operation of the lamp the reflector and lens of the headlight combine to produce a main beam from the filament 14. On the seal 2, the lamp has a lamp cap 15.

Figure 2:
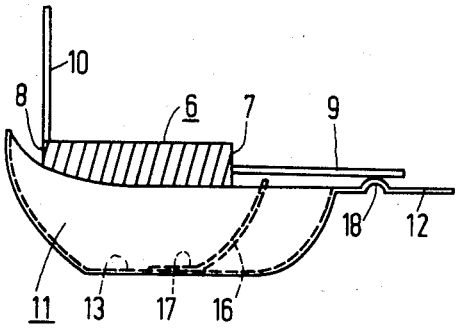
FIG. 2 shows a detail of FIG. 1 on an enlarged scale.

In FIG. 2, the lamp according to the invention is enlarged and more clearly visible. The screen 11 is provided with a reflecting tongue 16. Reflecting tongue 16 faces the filament 6 throughout its length and gradually moves away from the flat base portion 13 and extends to the end 7 of the filament 6, end 7 being remote from the seal 2 of the lamp vessel 1 (see FIG. 1). The tongue 16 has a concave cylindrically curved, reflecting surface, which faces the filament 6. The tongue 16 has a vane 17 being securely welded to the flat base portion 13. The vane 12 has a rib 18 on which a welding connection with the limb 9 is established.

Figure 3:
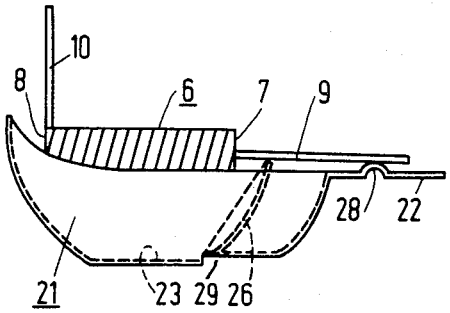
FIG. 3 shows another embodiment of a screen in side elevation.

In FIG. 3, parts of the screen 21 corresponding to parts of FIG. 2 are provided with a reference numeral which is 10 higher. The filament 6 is similar to that of FIG. 2. The tongue 26 is an integral part of the screen 21 and is obtained, for example, by stamping material out of the screen 21 and bending it inwards. The tongue 26 is then curved spherically with its concave side faces the filament 6.

Figure 4:
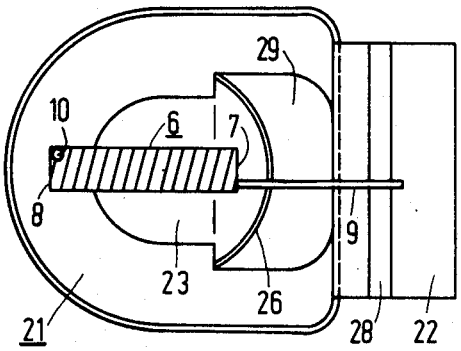
FIG. 4 is a plan view of the screen of FIG. 3.

In FIG. 4, reference numeral 29 denotes a window-like opening which is obtained by stamping out the tongue 26. The window-like opening 29 is screened from the filament by the tongue 26 bent towards the filament 6.

What is claimed is:

1. An electric incandescent lamp provided with a tubular glass lamp vessel which is sealed in a gas-tight manner and has a seal at a first end;

current supply conductors entering the lamp vessel through said seal;

a helically wound filament which is longitudinally arranged in the lamp vessel and has at each of its ends a limb connected to a respective current supply conductor; and an elongate concave reflecting screen in the lamp vessel, which extends along the filament whilst facing said filament with its concave side and which is curved substantially spherically at its end facing the said seal, has a vane extending longitudinally in the lamp vessel at is other end, and has a flat base portion, characterized in that the screen is provided with a reflecting tongue which faces the filament throughout its length and moves gradually away from the flat base portion of the screen and extends towards the end of the filament remote from the seal of the lamp vessel.

2. An electric incandescent lamp as claimed in claim 1, characterized in that the tongue has a concave surface directed towards the filament.

3. An electric incandescent lamp as claimed in claim 2, characterized in that the tongue is curved cylindrically about an axis which is arranged at right angles to the tubular lamp vessel.

4. An electric incandscent lamp as claimed in claim 2, characterized in that the tongue is curved spherically.

5. An electric incandescent lamp as claimed in claim 4, characterized in that the tongue is stamped out of the body of the screen and is bent inwardly towards the filament and screens the window then formed from the filament.

6. An electric incandescent lamp as claimed in claim 3, characterized in that the tongue is stamped out of the body of the screen and is bent inwardly towards the filament and screens the window then formed from the filament.

7. An electric incandescent lamp as claimed in claim 2, characterized in that the tongue is stamped out of the body of the screen and is bent inwardly towards the filament and screens the window then formed from the filament.

8. An electric incandescent lamp as claimed in claim 1, characterized in that the tongue is stamped out of the body of the screen and is bent inwardly towards the filament and screens the window then formed from the filament.

* * * * *